United States Patent [19]

Hofbauer et al.

[11] Patent Number: 4,516,552

[45] Date of Patent: May 14, 1985

[54] AIR QUALITY MEASURING DEVICE FOR A FUEL INJECTION INSTALLATION

[75] Inventors: August Hofbauer, Pforzheim; Erich Exinger, Stuttgart, both of Fed. Rep. of Germany

[73] Assignee: Dr. Ing. h.c.F. Porsche AG, Fed. Rep. of Germany

[21] Appl. No.: 546,557

[22] Filed: Oct. 28, 1983

[30] Foreign Application Priority Data

Oct. 30, 1982 [DE] Fed. Rep. of Germany ..... 3240271

[51] Int. Cl.[3] ..... F02M 39/00

[52] U.S. Cl. ..... 123/452; 73/118

[58] Field of Search ..... 123/452, 453, 454, 455; 73/118 A, 118, 861.74, 861.75, 861.76

[56] References Cited

U.S. PATENT DOCUMENTS

| | | | |
|---|---|---|---|
| 3,628,515 | 12/1971 | Knapp et al. | 123/455 |
| 3,915,138 | 10/1975 | Eckert et al. | 123/452 |
| 4,108,117 | 8/1978 | Stumpp et al. | 123/452 |
| 4,348,999 | 9/1982 | Holzbaur et al. | 123/452 |
| 4,392,386 | 7/1983 | Knetsch et al. | 73/118 A |

FOREIGN PATENT DOCUMENTS

| | | | |
|---|---|---|---|
| 2347865 | 4/1975 | Fed. Rep. of Germany | 123/452 |
| 2450208 | 5/1976 | Fed. Rep. of Germany | 123/452 |

*Primary Examiner*—Magdalen Y. C. Moy

*Attorney, Agent, or Firm*—Craig & Burns

[57] ABSTRACT

In an air quantity measuring device for a continuously operating fuel injection system, the baffle plate which actuates the control piston of the fuel quantity distributor by way of a lever, is provided with a raised portion on the inflow side thereof; to reduce the air-resistance of the baffle plate in a predeterminable manner, the peak of the raised portion is disposed eccentrically to the baffle plate in the lever-side half thereof, whereby the same air quantity measuring devices can be used for different measuring ranges by installing baffle plates with differently shaped raised portions.

15 Claims, 2 Drawing Figures

AIR QUALITY MEASURING DEVICE FOR A FUEL INJECTION INSTALLATION

Figure 1:
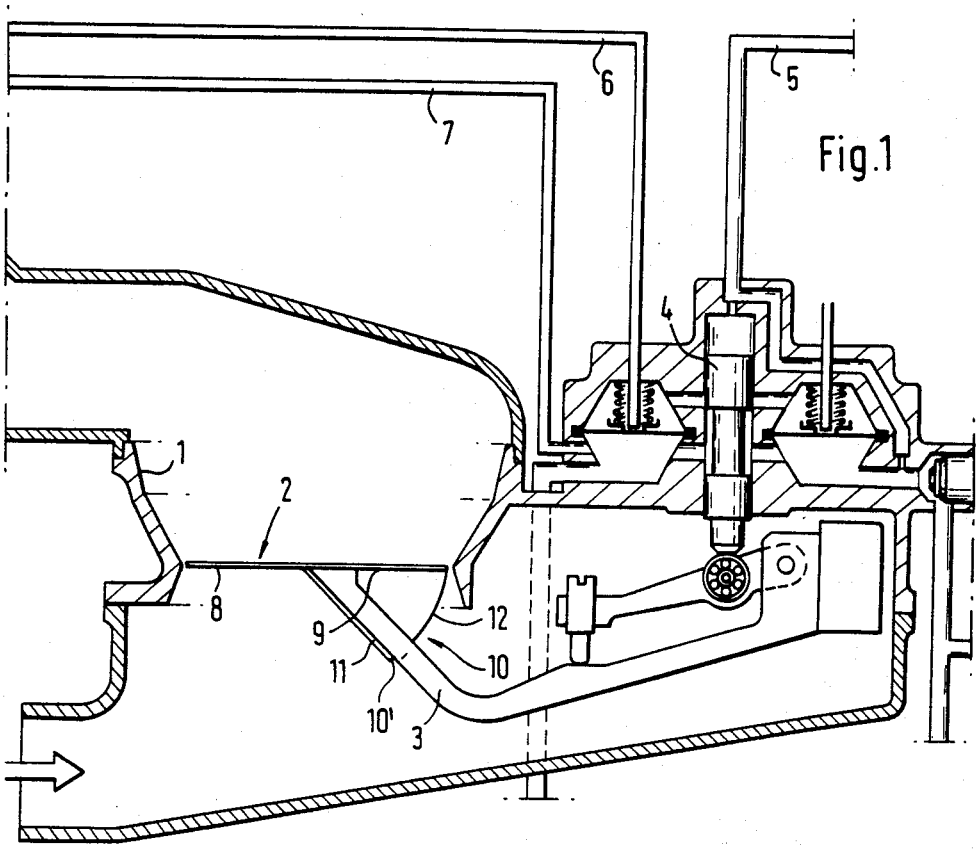

The present invention relates to an air quantity measuring device of a continuously operating fuel injection system for internal combustion engines with a pivotally arranged baffle plate, whose pivotal movements are used for actuating the control piston of a quantity distributor distributing the fuel to the injection valve connected thereto.

In an air quantity measuring device, as disclosed in the German Offenlegungsschrift No. 26 10 193, the baffle plate is provided on the inflow side thereof with a conical extension completely covering the same, which in conjunction with an air guide element fixedly arranged upstream of the baffle plate decreases the air resistance at the baffle plate. This measure is necessary in order to avoid the baffle plate deflecting fully in the partial load range in internal combustion engines with a high rate of air flow and which supply to the cylinders by way of the control piston of the quantity distributor the fuel quantity which is provided for full load.

The task of the present invention includes constructively simplifying such an air quantity measuring mechanism and to improve the same to such an extent that it can be used with a slight control pressure acting on the control piston.

The underlying problems are solved according to the present invention in that the baffle plate is provided with a raised portion on the inflow side thereof, whose peak is disposed eccentrically to the baffle plate in the half thereof on the side of the lever. The raised portion attached on the inflow side of the baffle plate covers somewhat more than the half of the baffle plate, to which the lever is attached. It rises in a plane or arcuate manner from the disc center of the baffle plate and then drops off to the edge of the baffle plate which is approximately spherically-shaped. It thus forms a guide surface and assures that the air from the annular gap between baffle plate and housing of the air quantity measuring device is deflected at the lever-side half of the baffle plate. Without such a guide surface eddies or vortices would occur thereat with respect to the flow during an inclined position of the baffle plate, which increase the flow resistance of the baffle plate. This vortex or turbulence formation would be increased with an increasing deflection of the baffle plate and the flow resistance would be increased so strongly that the baffle plate would deflect or pivot prematurely to its maximum position at partial load and therewith a regulation of the fuel quantity would become impossible. The formation of eddies or vortices is additionally favored by the lever which is screwed together with the baffle plate on the inflow side thereof in commercially available air quantity measuring devices.

According to a further feature of the present invention the raised portion on the inflow side is constructed as streamlined covering of the lever in a manner which is favorable from an aerodynamic point of view. By the selection of the shape and dimensions of such an air-guiding raised portion of the baffle plate, the regulating range of the air quantity measuring device can be changed within wide limits. Whereas with commercially available air quantity measuring devices having a plane inflow surface of the baffle plate corresponding to the rate of air flow and the control pressure of the fuel-injection system, the housings within which the baffle plate is deflected, are constructed differently, according to the present invention an adaptation can take place in the simpliest possible manner by a mere exchange of the baffle plate without having to change the housing.

Figure 2:
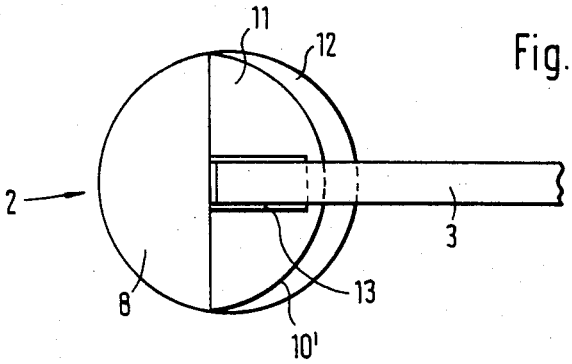

These and further objects, features and advantages of the present invention will become more apparent from the following description when taken in connection with the accompanying drawing which shows, for the purposes of illustration only, one embodiment in accordance with the present invention, and wherein:

FIG. 1 is a partial cross sectional view through a continuously operating fuel injection installation with an air quantity measuring mechanism and a quantity distribution mechanism in accordance with the present invention, and FIG. 2 is a plan view on the baffle plate and the lever of the air quantity measuring device in accordance with the present invention, as viewed from the inflow direction thereof.

Referring now to the drawings wherein like reference numerals are used throughout the two views to designate like parts, a baffle plate 2 is pivotal in a funnel-shaped widening housing 1 of an air quantity measuring device by means of a rotatably supported lever 3. The lever 3 thereby adjusts a control piston 4. Control piston 4 is operatively associated with a control pressure line 5. Depending on the position of the control piston 4, a corresponding fuel quantity is fed to the injection lines 6 leading to the individual cylinders of the internal combustion engine whereas in contrast the line 7 leading to a cold start valve always receives the same fuel quantity.

A raised portion generally designated by reference numeral 10 is adhesively fixed to the inflow side 8 of the baffle plate 2 in its half 9 on the side of the lever 3. The raised portion 10 is composed of a partial area 11 rising wedge-shaped and extending over the entire baffle plate width and of a partial area 12 spherically dropping off toward the edge of the baffle plate 2. The lever 3 is arranged in a central recess 13 and is surrounded by the raised portion 10 with a narrow gap. The raised portion 10 thereby rises approximately from the baffle plate center, then drops off to the edge of the baffle plate 2 and terminates flush therewith. The partial area 11 which rises wedge-shaped from the disc center may have either a flat contour or a curved contour.

By arranging the lever 3 in a central recess 13 of the baffle plate 2, the lever 3 is so integrated in the raised portion 10 that an overall inflow surface results which is aerodynamically favorable. It has been found that the air quantity measuring device can be used for different measuring ranges by utilizing differently shaped raised portions with the baffle plates.

The raised portion 10 may be of any suitable material, for example, synthetic resinous material and in that case may be adhesively fixed to the baffle plate by any suitable glue. However, it is also possible to press the raised portion into a metallic baffle plate.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. An air quantity measuring device of a continuously operating fuel injection installation for an internal combustion engine, comprising a baffle plate means pivotally arranged in a housing on a lever, the pivoting movements of the baffle plate means being dependent on the through-flowing air quantity, for actuating a control piston of a quantity distributor for the distribution of fuel to cylinders of the internal combustion engine, the baffle plate means being provided on its inflow side with a raised means for reducing its flow resistance, the raised means having a peak disposed eccentrically to the baffle plate means and including a first portion rising approximately from the center of the baffle plate means to said peak and a second portion dropping off from the peak to the edge of the baffle plate means and terminating flush therewith.

2. An air quantity measuring device according to claim 1, wherein the raised means is disposed in the half of the baffle plate means to which the lever is attached.

3. An air quantity measuring device according to claim 2, wherein the first portion is formed of a partial area rising wedge-shaped from the center of the baffle plate means and extending over the entire width thereof and the second portion is a partial area dropping off substantially spherically-shaped to the edge of the baffle plate means.

4. An air quantity measuring device according to claim 3, wherein the first portion has a flat contour in the wedge-shaped rising area.

5. An air quantity measuring device according to claim 3, wherein the first portion has an arcuate contour in the wedge-shaped rising area.

6. An air quantity measuring device according to claim 3, wherein the lever is integrated into the raised means so that an overall inflow surface results which is aerodynamically favorable.

7. An air quantity measuring device according to claim 6, wherein the lever is disposed substantially centrally with respect to the first portion and is surrounded by the same in an aerodynamically favorable manner.

8. An air quantity measuring device according to claim 7, wherein the raised means is formed of synthetic plastic material and is bonded to the baffle plate means.

9. An air quantity measuring device according to claim 7, wherein the baffle plate means is metallic and the raised means is pressed into the baffle plate means.

10. An air quantity measuring device according to claim 7, wherein the first portion has a flat contour in the wedge-shaped rising area.

11. An air quantity measuring device according to claim 7, wherein the first portion has an arcuate contour in the wedge-shaped rising area.

12. An air quantity measuring device according to claim 1, wherein the lever is integrated into the raised means so that an overall inflow surface results which is aerodynamically favorable.

13. An air quantity measuring device according to claim 12, wherein the lever is disposed centrally with respect to the first portion and is surrounded by the same in an aerodynamically favorable manner.

14. An air quantity measuring device according to claim 1, wherein the raised means is formed of synthetic plastic material and is bonded to the baffle plate means.

15. An air quantity measuring device according to claim 1, wherein the baffle plate means is metallic and the raised means is pressed into the baffle plate means.

* * * * *